United States Patent [19]

DeRezendes

[11] 4,167,385

[45] Sep. 11, 1979

[54] CONCRETE MOLD

[75] Inventor: Frank E. DeRezendes, San Ramon, Calif.

[73] Assignee: J. M. Leaver, Lafayette, Calif.

[21] Appl. No.: 874,439

[22] Filed: Feb. 2, 1978

[51] Int. Cl.[2] ..... B28B 3/04

[52] U.S. Cl. ..... 425/410; 425/420; 425/812

[58] Field of Search ..... 425/84, 410, 412, 420, 425/812; 249/121, 141

[56] References Cited

U.S. PATENT DOCUMENTS

| | | | |
|---|---|---|---|
| 1,272,647 | 7/1918 | Ferguson | 425/410 |
| 1,333,621 | 3/1920 | Kempton | 249/141 |
| 2,899,734 | 8/1959 | Klang | 249/141 |
| 3,291,873 | 12/1966 | Eakin | 249/141 |
| 3,357,072 | 12/1967 | Sutphin | 425/812 |
| 3,385,205 | 5/1968 | McCloud | 249/121 |
| 3,844,527 | 10/1974 | Scott | 249/112 |
| 3,954,377 | 5/1976 | Scholz et al. | 249/16 |
| 4,035,122 | 7/1977 | Cavanaugh | 425/410 |
| 4,121,896 | 10/1978 | Shepherd | 425/412 |

FOREIGN PATENT DOCUMENTS

| | | | |
|---|---|---|---|
| 1003037 | 9/1965 | United Kingdom | 425/DIG. 44 |

*Primary Examiner*—John McQuade

*Attorney, Agent, or Firm*—Townsend and Townsend

[57] ABSTRACT

A mold for forming concrete articles comprises a face mold and a compression lid which are relatively configured so that the compression lid can be progressively inserted within the face mold to define a mold cavity which decreases in size. The mating edges of the face mold and compresssion lid define a relief area between them adjacent to, and communicating with the cavity. Each mating edge has a flange, and the flanges abut and prevent further insertion of the compression lid into the face mold when the proper size of the article being formed is attained. The mating edges further have corrugations defining a plurality of channels which extend between the relief area and the exterior of the mold. Excess water from concrete mixture being compressed between the face mold and compression lid can flow from the cavity, through the relief area, through the channels, and out of the mold.

15 Claims, 3 Drawing Figures

CONCRETE MOLD

BACKGROUND OF THE INVENTION

This invention relates to concrete products and structure for making the same. More particularly, the invention relates to molds for fabricating concrete slabs with stylized surface patterns.

Precast concrete slabs have been used in the building construction industry for many years. Usually, the concrete slabs are poured using production line techniques at a remote factory site and then transported to various construction sites where the slabs are used in the construction of exterior walls, floors, roofs, fireplace hearths, etc. One of the many advantages of precasting concrete slabs is the ability to place a stylized pattern onto the surface of the slab during its casting. A number of devices have been invented to facilitate the molding of such concrete slabs. For example, U.S. Pat. No. 3,954,377 discloses a vertical mold for making textured concrete panels.

When the concrete mixture is prepared water is added for two reasons: First, it is necessary for hydrolysis, a chemical reaction which occurs as the cement hardens; and second, it is necessary to put the mixture into a semi-liquid state so that it can be poured into the mold and impressed with a stylized surface pattern. If there is insufficient water in the mixture it is difficult to obtain the desired pattern detail. However, it is well known that a reduction in the amount of water in excess of the amount needed for hydrolysis increases the strength and density of the resulting concrete.

Various techniques have been developed to remove excess water from concrete which has been poured into a mold. These include the application of heat, vibration, pressure, suction, vacuum, or any combination of these, to the concrete mixture while it is in the mold before the hardening process begins. However, known techniques require the utilization of complicated and often cumbersome apparatus, such as that disclosed in U.S. Pat. No. 2,311,358 or in U.S. Pat. No. 2,798,278. Frequently they do not produce articles with precise and uniform dimensions. Often the detail of the stylized surface patterns is not of high quality.

SUMMARY OF THE INVENTION

The present invention provides a durable mold of relatively simple construction which can be readily used to form concrete articles with precise and uniform dimensions and with stylized patterns of excellent detail on all surfaces of the articles. It allows excess water to be quickly and efficiently removed from the concrete mixture without the necessity of using complex heat, vibration, suction, or vacuum apparatus. The proportion of water in the concrete mixture can be greatly reduced after the mixture has been poured into the mold so that the density and strength of the finished articles is significantly increased.

The mold of the present invention comprises a face mold and a compression lid which are relatively configured so that the compression lid can be progressively inserted within the face mold to define a mold cavity which decreases in size. The mating edges of the face mold and compression lid define a relief area between them adjacent to, and communicating with the cavity. Each mating edge has a flange, and the flanges abut and prevent further insertion of the compression lid into the face mold when the proper size of the article being formed is attained. The mating edges further have corrugations defining a plurality of channels which extend between the relief area and the exterior of the mold. Excess water from concrete mixture being compressed between the face mold and compression lid can flow from the cavity, through the relief area, through the channels, and out of the mold.

The novel features which are believed to be characteristic of the invention, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
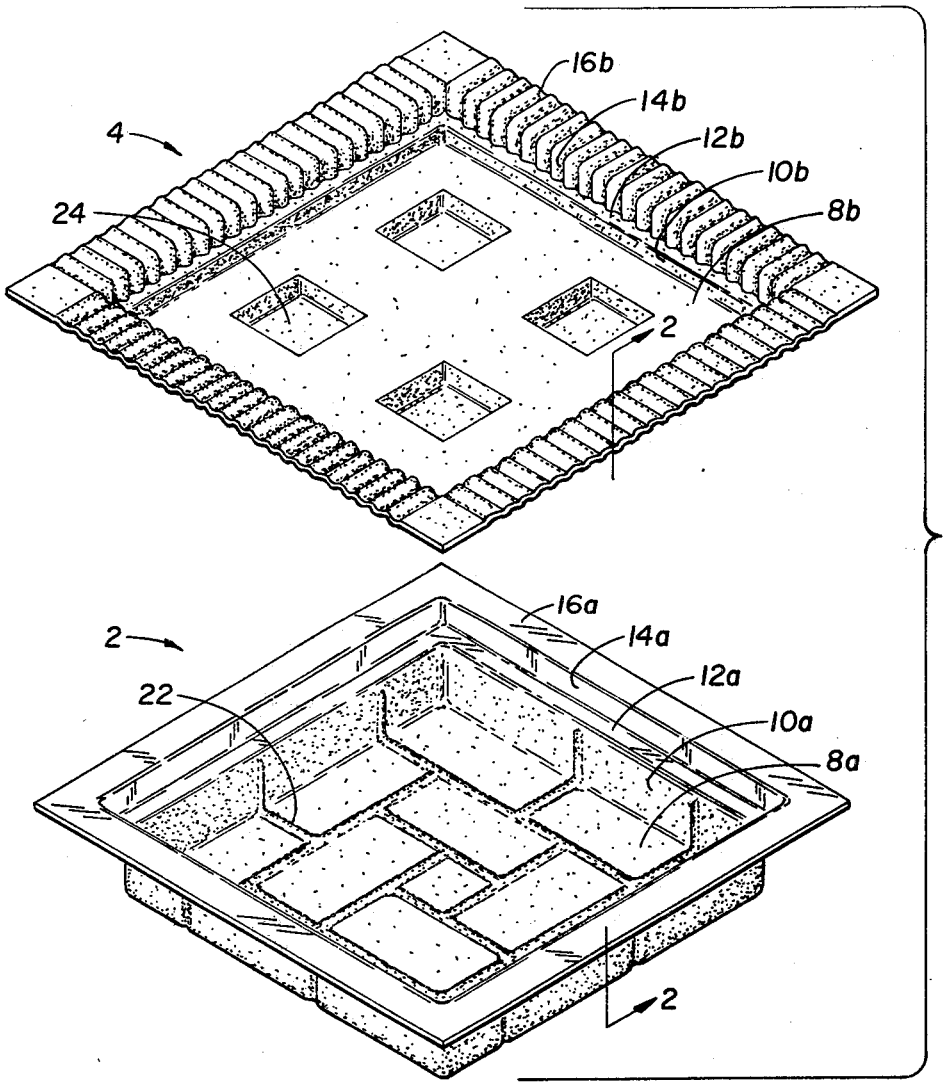
FIG. 1 is an exploded perspective view of one embodiment of the mold of the present invention showing the face mold and the compression lid.
Figure 2:
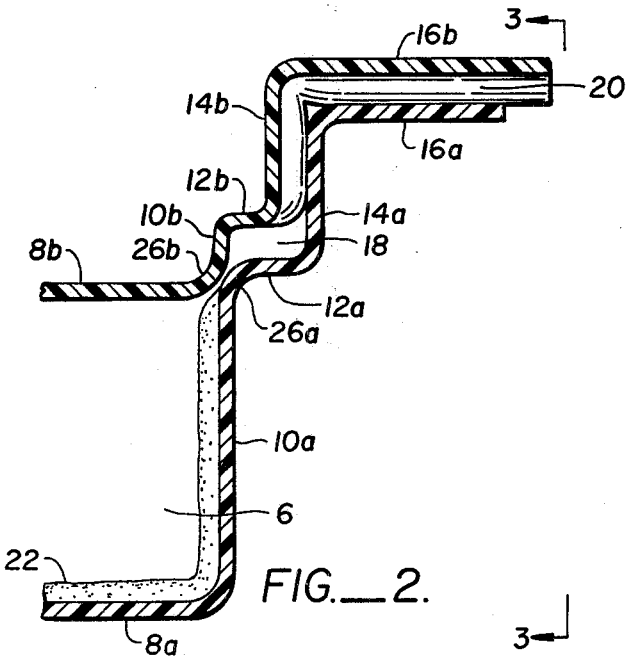
FIG. 2 is a partial sectional view of the compression lid fully inserted in the face mold taken along line 2—2 of FIG. 1.

Referring to FIG. 1, one embodiment of the present invention comprises a face mold 2 and a compression lid 4. As shown in FIG. 2, the face mold and compression lid are relatively configured so that the compression lid can be progressively inserted within the face mold to define a mold cavity 6 which decreases in size as the compression lid is inserted further and further into the face mold.

Continuing with FIG. 2, the face mold and compression lid include horizontally disposed, generally planar sections **8*a* and 8*b* which are surrounded by vertically extending side walls 10*a* and 10*b*. The side walls are surrounded by first flanges 12*a* and 12*b* which extend horizontally outward from the upper edges of side walls 10*a* and 10*b* respectively. The first flanges are surrounded by guide walls 14*a* and 14*b* which extend vertically from the outermost edges of first flanges 12*a* and 12*b*, respectively. The guide walls are surrounded by second flanges 16*a* and 16*b* which extend horizontally outward from the upper edges of guide walls 14*a* and 14*b***, respectively.

Figure 3:
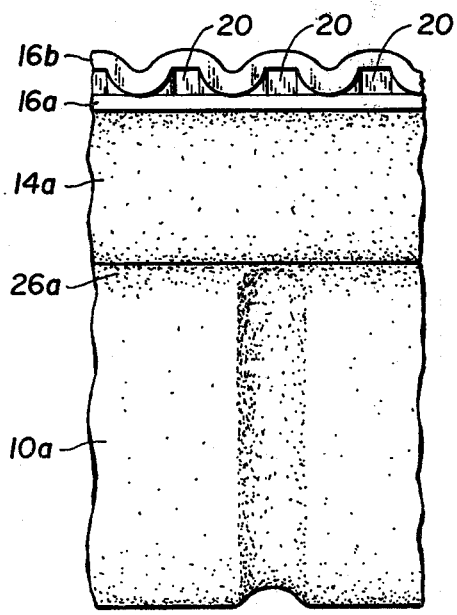
FIG. 3 is a partial elevational view of the face mold and compression lid taken along line 3—3 of FIG. 2.

As shown in FIGS. 1–3, guide walls **14*b* and second flange 16*b* of compression lid 4 are corrugated. When the compression lid is inserted in the face mold, the corrugations of guide walls 14*b* come into sliding contact with guide walls 14*a*** and the face mold and the compression lid act as a cylinder and piston respectively.

When the corrugations of second flange **16*b* of the compression lid abut second flange 16*a* of the face mold with the flanges in mating relationship at their edges, further insertion of the compression lid into the face mold is prevented. The mating edges of the face mold and compression lid are dimensioned so that this occurs when the proper size of the article being formed is attained. The vertical dimension of side walls 10*b* of the compression lid is substantially less than that of side walls 10***a* of the face mold.

It is preferable that the level of the first flange 12*a* of the face mold be slightly higher than the level of planar section 8*b* of the compression lid when the compression lid is fully inserted in the face mold. The relative difference between these levels determines how much the material in the mold cavity is compressed. This difference will vary from mold to mold depending upon the relative proportion of liquid or other substance that is to be removed from the material being compressed and depending upon the compressibility of the mixture. First flanges 12*a* and 12*b* define a relief area 18 between them which is adjacent to, and communicates with mold cavity 6.

Referring to FIGS. 2 and 3, the corrugations in second flange 16*b* and guide walls 14*b* of the compression lid define a plurality of channels 20 which extend first horizontally and then vertically between the exterior of the mold and relief area 18. It is preferable that channels 20 substantially surround mold cavity 6 so that excess water can be expelled evenly on all sides of the mold.

The surfaces of the face mold and compression lid which define the mold cavity are appropriately textured or relieved so that a stylized pattern can be impressed upon all sides of the mixture. As shown in FIG. 1, the face mold and compression lid are textured or dimpled (shown in dots) and have an array of raised portions 22 which provide the article with simulated mortar lines. The articles formed with the mold of FIG. 1 will have a surface appearance which simulates masonry.

Compression lid 4 has downwardly projecting portions 24 so that the articles will have cavities opening on one side thereof. These projecting portions can be of any size, shape, and number, but preferably they are large enough so that the weight of the articles is substantially reduced without sacrificing their strength. The cavities formed in this manner may also serve to hold pockets of air and thus give the articles insulating properties.

The face mold and compression lid may be made of any suitable material. They can be vacuum molded or thermal formed out of sheets of plastic. Sheets made of acrylic butyl styrene are preferred since they shrink a minimal amount after they have been thermally formed. Face molds and compression lids molded out of these sheets are strong and durable due to the resilience of the material.

Having described the construction of the mold, the manner of its operation is as follows. The face mold is preferably placed in a wooden container (not shown) which supports its planar section, its side walls, and its mating edge assembly. The mixture contacting surfaces of the face mold and compression lid are coated with a standard form oil to prevent the mixture from sticking to the mold. A pre-determined amount of a cementitious mixture including water and a binding material (such as cement) is poured into the mold. The mixture includes enough water to ensure that excellent detail of the stylized surface patterns will be obtained. Generally the face mold is filled to a level slightly below first flange 12*a* and a board or "screed" is slid over the face mold to remove any excess mixture so that when compressed the desired thickness is attained. Alternatively the proper amount of mixture could be determined by weight. Next, reinforcing in the form of rod, mesh, or fabric can be added.

The compression lid is then placed over the face mold and a layer of urethane foam or other semi-compressible material (not shown) is placed above planar section 8*b* of the compression lid. A downward force is gradually exerted against the semi-compressible material uniformly over its area. This may be accomplished by a system of uniformly disposed weights or by any simple mechanical device such as a hydraulic apparatus. Generally, forces ranging from 5 psi to 40 psi are suitable, however, depending upon the composition of the mixture, the weight of the lid itself may suffice. The force is preferably exerted for a period of at least 20 minutes.

As force is being exerted against the compression lid, the lid will progressively be inserted further and further into the face mold. The mixture being compressed will spread uniformly throughout the mold cavity and the stylized pattern will be impressed into the surfaces of the mixture. Excess water from the mixture will be squeezed out and will flow from the mold cavity, through the relief area, through the channels, and out of mold. It is important that the force be exerted against the compression lid gradually, so that only water will be expelled. If the force is not exerted gradually, some of the mixture will flow into the relief area and into the channels.

The second flanges will abut and prevent further insertion of the compression lid when the proper thickness of the article is attained. At the point of full insertion corners 26*a* and 26*b* of the face mold and compression lid are almost together. A small amount of mixture may seep through the small space between corners 26*a* and 26*b*, however, the resulting excess material on the hardened article may be easily removed. At the point of full insertion some water which has been squeezed from the mixture will not be completely expelled from the mold but will remain in the relief area and in the channels. However this water can only contact the cement mixture over a small surface area defined by the space between corners 26*a* and 26*b*. This minimizes the amount of water that is reabsorbed by the mixture during the setting period. It may be desirable to have corners 26*a* and 26*b* meet at a point of full insertion to substantially eliminate water reabsorption. The water which remains in the relief area and in the channels can be sucked out or the mold can be flipped so that it will flow out.

Although one embodiment of the present invention has been shown and described, it is obvious that other adaptations and modifications of this embodiment can be made without departing from the true spirit and scope of the present invention. For example, the mold cavity need not be rectangular but may be shaped like a circle, oval, cross, "T", etc. The mold can be dimensioned so that its cavity has a height which is greater than its width. The height of the cavity can be graduated. Furthermore the mold can be used to form articles made from various other materials such as plaster or urethane foam in which case excess amounts of the material will be expelled from the mold cavity through the relief area and channels.

What is claimed is:

1. A mold for forming articles made from a cementitious mixture including water and a binding material, the mold comprising flanged upper and lower members, one member being adapted to be progressively inserted within the other until the respective flanges come into contact for compressing a quantity of cementitious mixture in the cavity between the said members, the flanges of the members having portions on the upper side of one and lower side of the other to define a plurality of channels which extend between the formed cavity and the exterior of the mold when said flanges are in contact whereby excess water from cementitious mixture being compressed between the members can flow through the channels and out of the mold.

2. The mold of claim 1 wherein the portions defining channels substantially surround the formed cavity at all times.

3. The mold of claim 1 wherein one of the flange portions defining the channels is corrugated.

4. A mold for forming concrete articles comprising upper and lower members, of related configuration, each said member having outwardly extending flanged mating edges, the said upper member being adapted to be progressively inserted within the lower member to define a cavity between the members which with progressive insertion of the said upper member decreases in size, the mating outwardly extending edges of the members defining a relief area between them adjacent to, and communicating with, the cavity, the mating edges abutting and preventing further insertion of the upper member into the lower member when the proper size of the article being formed is attained, the mating edges further having portions defining a plurality of channels which extend between the relief area and the exterior of the mold whereby excess water from concrete mixture beng compressed between the members can flow from the cavity, through the relief area, through the channels, and out of the mold.

5. The mold of claim 4 wherein the portions defining channels substantially surround the cavity.

6. The mold of claim 4 wherein one of the mating edge is corrugated to define said channels.

7. A mold for forming concrete articles comprising upper and lower members of related configuration, each member including a horizontally disposed, generally planar section which is surrounded by vertically extending side walls, a first flange which extends horizontally outward from the upper edges of the side walls, guide walls which extend vertically from the outermost edges of the first flange, and a second flange which extends horizontally outward from the upper edges of the guide walls, the vertical dimension of the upper member side walls being less than that of the lower member side walls, the upper member being adapted to be progressively inserted within the lower member to define a cavity between the planar sections which cavity decreases in size as insertion progresses, the first flanges defining a relief area between them adjacent to, and communicating with the cavity, the guide walls and second flanges having portions defining a plurality of channels extending between the exterior of the mold and the relief area, the second flanges abutting and preventing further insertion of the upper member into the lower member when the proper size of the article being formed is attained, whereby excess water from concrete mixture being compressed between the members can flow from the cavity, through the relief area, through the channels, and out of the mold.

8. The mold of claim 7 wherein the portions defining channels substantially surround the cavity.

9. The mold of claim 7 wherein part of the portions defining channels are corrugations.

10. The mold of claim 7 wherein each member is molded from a sheet of resilient material.

11. The mold of claim 7 wherein the side walls and planar section of the lower member have textured portions for impressing a stylized surface pattern into the concrete mixture.

12. The mold of claim 7 wherein the planar section of the upper member has portions which project downwardly into the concrete mixture so that the formed article has cavities opening on one side thereof which are sufficiently large to substantially reduce the weight of the article.

13. The mold of claim 7 wherein the level of the first flange of the lower member is higher than that of the planar section of the upper member when the second flanges are abutted.

14. The mold of claim 7 wherein the junction between the side walls and first flange of the lower member is in contact with the junction between the side walls and planar section of the upper member when the second flanges of the members are abutted.

15. A mold for forming concrete articles comprising upper and lower members of related configuration each fabricated from a single sheet of resilient material and including a horizontally disposed, generally planar section which is surrounded by vertically extending side walls, a first flange which extends horizontally outward from the upper edges of the sidewalls, guide walls which extend vertically from the outermost edges of the first flange, and a second flange which extends horizontally outward from the upper edges of the guide walls, the vertical dimension of the upper member side walls being less than that of the lower member side walls, the upper member being adapted to be progressively inserted within the lower member to define a cavity between the planar sections, the cavity decreasing in size as insertion progresses, the first flanges defining a relief area between them adjacent to, and communicating with the cavity, the guide walls and second flange of one of said members being corrugated to define a plurality of channels substantially surrounding the cavity and extending between the exterior of the mold and the relief area, the second flanges abutting and preventing further insertion of the upper member into the lower member when the level of the first flange of the lower member is higher than that of the planar section of the upper member and the junction between the side walls and first flange of the lower member is in contact with the junction between the side walls and planar section of the upper member, whereby excess water from concrete being compressed between the members can flow from the cavity, through the relief area, through the channels, and out of the mold.

* * * * *